US006029912A

United States Patent [19]

Woolley

[11] Patent Number: 6,029,912

[45] Date of Patent: Feb. 29, 2000

[54] DEVICE FOR PRODUCING A STREAM OF AERATED WATER AND CONSTRUCTION THEREOF

[75] Inventor: Jack Francis David Woolley, London, United Kingdom

[73] Assignee: Aqualisa Products Limited, Kent, United Kingdom

[21] Appl. No.: 08/783,510

[22] Filed: Jan. 14, 1997

[30] Foreign Application Priority Data

Jan. 16, 1996 [GB] United Kingdom ..... 9600856

[51] Int. Cl.[7] ..... E03C 1/08

[52] U.S. Cl. ..... 239/428.5; 239/543

[58] Field of Search ..... 239/398, 428.5, 239/432, 543, 544, 545, 500

[56] References Cited

U.S. PATENT DOCUMENTS

| | | | |
|---|---|---|---|
| 1,189,593 | 7/1916 | Lynn | 239/543 |
| 2,051,108 | 8/1936 | Sattler | 239/544 |
| 2,221,995 | 11/1940 | Parrigin | 239/544 |
| 2,675,218 | 4/1954 | Bletcher et al. | 239/428.5 |
| 2,785,926 | 3/1957 | Lataste | 239/543 |
| 3,116,018 | 12/1963 | Kunz | 239/543 |
| 4,403,739 | 9/1983 | Knapp et al. | 239/428.5 |

FOREIGN PATENT DOCUMENTS

| | | |
|---|---|---|
| 696787 | 9/1953 | United Kingdom . |
| 1038638 | 8/1966 | United Kingdom . |
| 1202040 | 8/1970 | United Kingdom . |
| WO 94/07607 | 4/1994 | WIPO . |

*Primary Examiner*—Andres Kashnikow
*Assistant Examiner*—Lisa Ann Douglas
*Attorney, Agent, or Firm*—Harness, Dickey & Pierce, P.L.C.

[57] ABSTRACT

A device for producing a stream of aerated water, the device having a first opening for producing a first jet of water and a second opening for producing a second jet of water directed into the first jet of water so as to form a single turbulent stream of water in which air is entrained. The device being constructed by forming two relatively angled surfaces on at least one component, the surfaces having respective aligned grooves, forming two oppositely angled surfaces on at least one other component and mounting the two relatively angled surfaces against the two oppositely angled surfaces such that the grooves, together with the oppositely angled surfaces define passages for the formation of jets of water.

17 Claims, 3 Drawing Sheets

DEVICE FOR PRODUCING A STREAM OF AERATED WATER AND CONSTRUCTION THEREOF

FIELD OF THE INVENTION

The present invention relates to a device for producing a stream of aerated water and a method of constructing such a device. More particularly, it relates to a device for use in shower heads and the like where multiple streams of water are required, each having a proportionally high volume of air entrained in the water to give it a pleasing and soft feel. It also relates to a method of constructing such a device.

DESCRIPTION OF THE RELATED ART

Previously, there have existed devices for producing streams of aerated water. These devices are connected to a common source of water, for instance the water inlet of the shower head, and produce a number of jets of water. In one design, the jets of water are directed against stepped surfaces known as weirs or stepped weirs leading to respective water outlets. As a result of reflection and deflection of the water jets on different parts of the stepped surfaces, the water mixes with air and the mixture flows out as an aerated stream of water. In another design, one or two sheets of gauze, held apart by a moulding, are placed in the path of the jets of water.

These previous aerating devices have a number of problems. To provide effective mixing of water and air, it is necessary to provide a large number of steps through which the water is to cascade. This requires an undesirable amount of space and, in construction, requires a large number of components, thereby adding to the cost. Similarly, using sheets of gauze requires a large number of parts, complex assembly and undesirable expense. Furthermore, due to the impact of the relatively hot water against the relatively cold surfaces of the step portions and gauze, scaling may occur, thereby resulting in reduced performance.

OBJECT AND SUMMARY OF THE INVENTION

It is an object of the present invention to provide an improved aeration device which is more easily constructed.

According to the present invention there is provided a device for producing a stream of aerated water, the device comprising:

first means for producing a first jet of water; and second means for producing a second jet of water directed so as to impact with the first jet of water; wherein the first and second means are each formed from respective pairs of co-operating surfaces, at least one co-operating surface of each pair having a groove which, together with the other co-operating surface of that pair, defines a passage for the formation of a jet of water and wherein the first means and the second means are angled relative to one another with an angle such that the first and second jets impact with one another at said angle so as to form a turbulent stream of water in which air is entrained, the device further comprising:

an outlet for said turbulent stream of aerated water and walls for channelling said stream to said outlet.

There is a problem in providing angled jets of water, particularly when a plurality of such jets are to be provided. In particular, for ease and efficiency of production, components in devices such as shower heads are usually produced by moulding plastic, but it is extremely difficult to provide a mould which produces one or more pairs of passages which are angled to one another in the manner required.

Thus, according to a further aspect of the present invention there is provided a shower head for producing a stream of aerated water, the shower head comprising:

first means for producing a first jet of water; and second means for producing a second jet of water directed so as to impact with the first jet of water; wherein the first and second means are each formed from respective pairs of co-operating surfaces, at least one co-operating surface of each pair having a groove which, together with the other co-operating surface of that pair, defines a passage for the formation of a jet of water and wherein the first means and the second means are angled relative to one another with an angle such that the first and second jets impact with one another at said angle so as to form a turbulent stream of water in which air is entrained, the shower head further comprising:

an outlet for said turbulent stream of aerated water and walls for channelling said stream to said outlet.

Furthermore, according to another aspect of the present invention there is provided a method of constructing a device for producing a stream of aerated water, the device comprising a first channel for producing a first jet of water and a second channel for producing a second jet of water directed so as to impact with the first jet of water to form a turbulent stream of water in which air is entrained, the method comprising forming each channel from a respective pair of surfaces which are mounted together so as to form a substantially sealing interface, at least one of each pair of surfaces having a groove which forms the respective channel and angling the first and second channels relative to one another such that the first and second jets impact with one another at said angle so as to form a turbulent stream of water in which air is entrained:

forming an outlet for said stream of aerated water; and forming walls for channelling said stream to said outlet.

DETAILED DESCRIPTION OF THE PREFERRED EMBODIMENTS

The present invention will be more clearly understood from the following description, given by way of example only, with reference to the accompanying drawings.

The following description relates to a shower head. However, the present invention is not limited to shower heads and may also be applied to other aerated water outlets.

The shower head produces a number of streams of aerated water, each stream being-formed from at least two jets of water. The way in which the aerated streams of water are produced may be understood by reference to FIGS. 1 to 4.

Figure 1:
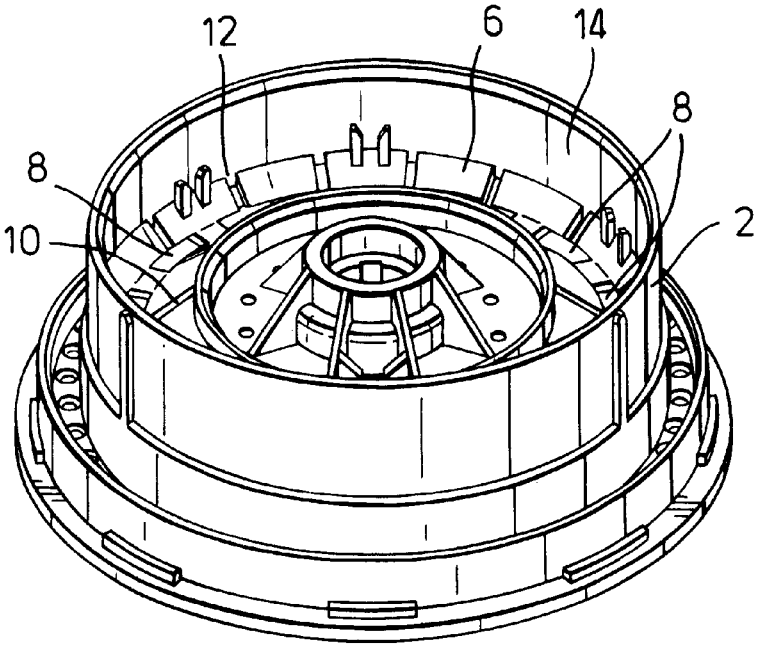
FIG. 1 illustrates the inlet side of a first component of a first embodiment of the present invention.

A number of pairs of jets of water are produced by the combination of a base member 2 and an annular ring 4. As illustrated in FIG. 1, the base member 2 has an annular V-shaped recess 6 having at its base, i.e. the apex of the "V", a plurality of apertures 8. Either side of each aperture 8 are two, optionally square cross-section, grooves 10 and 12 which extend radially in the sides of the V-shaped portion 6. As illustrated, the grooves are of square cross-section, but other cross-sections could be used. Furthermore, the size and shape of the apertures 8 is not in itself essential to the invention and, indeed, all of the apertures 8 could be replaced by a single annular aperture.

Figure 2:
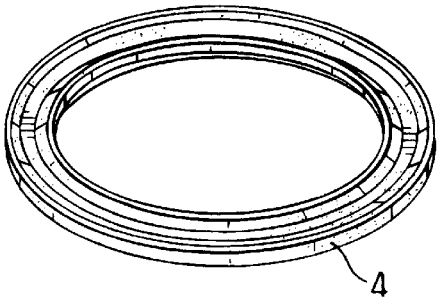
FIGS. 2 and 3 illustrate the two sides of a second component of the first embodiment.
Figure 3:
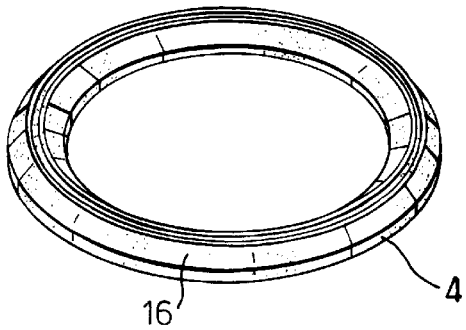

The annular ring 4, as illustrated in FIGS. 2 and 3, is shaped so as to fit in the annular V-shaped indent 6. Indeed, provided the annular ring 4 and the indent of the base member 2 are shaped with corresponding surfaces which fit together in a generally sealing manner, they need not be V-shaped.

Figure 4:
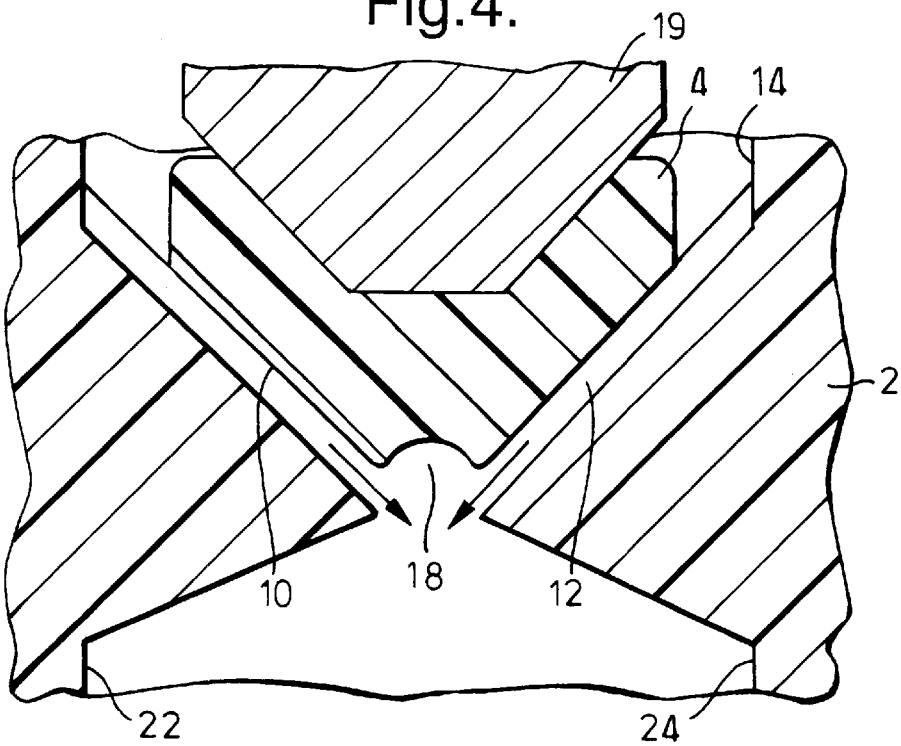
FIG. 4 illustrates how the components of FIGS. 1, 2 and 3 fit together.

As illustrated in FIG. 4, when the annular ring 4 is fitted into the V-shaped indent 6 of the base member 2, an annular space is left between the sides of the annular ring 4 and axially extending side walls 14 of the base member 2. Furthermore, since the annular ring 4 has surfaces 16 which are shaped so as to match the sides of the V-shaped recess 6, it does not fill the grooves 10 and 12. In this way, when a pressurised supply of water is provided on the annular ring side of the base member 2, jets of water are produced from the passages formed by the surfaces 16 of the annular ring 4 and the grooves 10 and 12. As illustrated in FIG. 4 with arrows, these jets impact upon one another, break up and entrain air into their resulting flow.

At the point of exit, the angle of the V-shape of the base member 2 and the annular ring 4 determines the angle at which the two jets of water impact upon one another. Thus, if the angle between the two sides of the V-shape is increased, the relative velocity between the two jets is also increased so as to increase the effect of breaking up the water. However, to increase the through flow velocity, the angle between the sides of the V-shape must be reduced. It has been found that any angles in the region of 90° provide a suitable effect. However, the optimum angle is dependent on a number of external factors such as jet cross-sectional area, jet velocity and the volume and shape of the space in which the impacting jets are confined. For any particular application, the angle may be varied until the desired aeration occurs.

As illustrated in FIG. 4, the annular ring 4 preferably has an indented portion 18 in place of the apex of the V-shape. Although the annular ring 4 could have a flat bottom face so as to directly traverse the aperture 8 of the base member 2, by providing the indent 18, the space in which the two jets of water may mix is increased. Furthermore, any surface tension effects with the annular ring 4 will be reduced. In other words, the water is more likely to adhere to a flat bottom face than an indented one.

Similarly, as illustrated in FIGS. 2 and 4, the opposite side of the annular ring 4 is also indented. This is to allow a further component, rib 19, to press the annular ring 4 into a good sealing fit with the V-shaped indent surfaces. By ensuring a good seal and providing the maximum length of water passageway between the ring 4 and the grooves 10 and 12, consistent water jets may be ensured which collide as required.

It is particularly important that a good seal is provided at the outlets and this is more difficult to achieve as the angle between the jets increases. One solution is to increase the force pressing the sealing surfaces together. However, this complicates construction and introduces stresses into the device. Indeed, it becomes impractical to construct a device with sufficiently angled jets to produce the required aeration. Preferably, therefore, the annular ring 4 is made of a resilient/compliant material, such as a rubber/elastomer. This allows only a moderate sealing force to be applied and improves the sealing effect between the annular ring 4 and the V-shape surfaces 6 of the base member 2 such that water only flows through the base member 2 via the grooves 10 and 12.

Thus, a plurality of opposing pairs of water jets may be produced easily with only two components, each of which is in itself easily moulded.

Of course, the base member could be produced from a rubber or rubber like material and the grooves could be formed in the annular ring 4. However, the embodiment described above is preferred.

Figure 5:
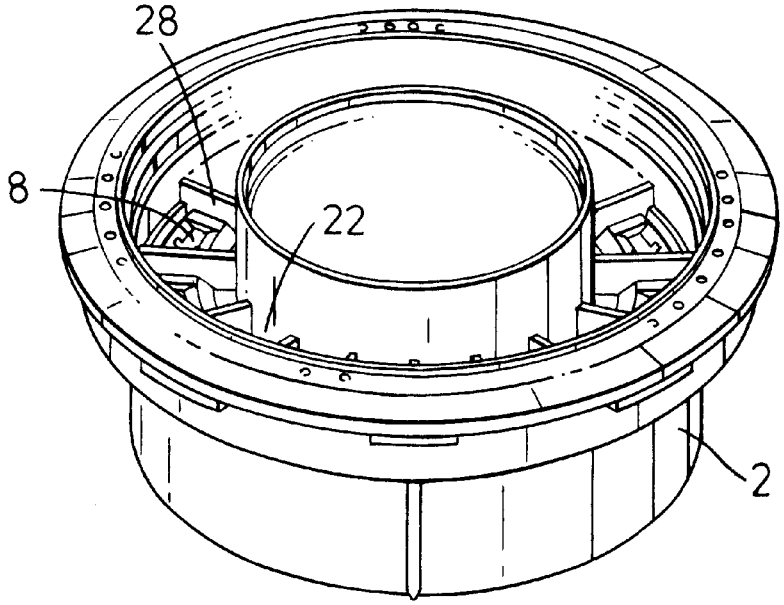
FIG. 5 illustrates the outlet side of the component of FIG. 1.
Figure 6:
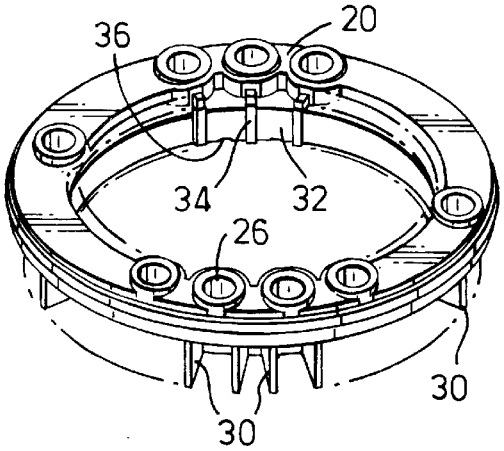
FIGS. 6 and 7 illustrate the two sides of a third component of the first embodiment.
Figure 7:
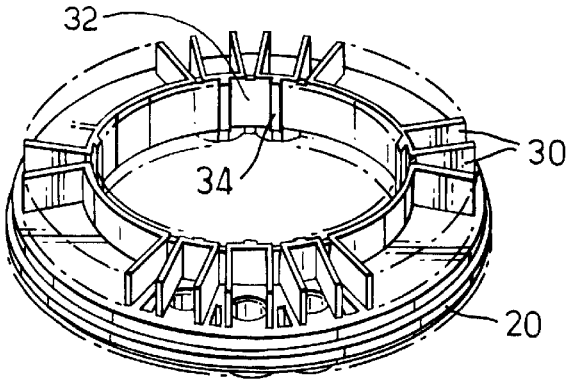

FIG. 5 illustrates the underside of the base member 2 and FIGS. 6 and 7 illustrate an outlet portion 20 which is inserted between inner 22 and outer 24 axially extending walls of the base member 2.

In the illustrated embodiment, the outlet portion 20 has a plurality of circular outlet openings 26, each corresponding to a pair of grooves 10 and 12. However, it is also possible to embody the present invention in an apparatus having an outlet path which combines the flows of adjacent streams of aerated water such that, with the apparatus described above, an annular stream of aerated water would be produced.

As illustrated in FIG. 5, each aperture 8 is separated from the adjacent aperture 8 by means of a wall 28. In this way, in conjunction with walls 22, 24 and 32, the impacting jets are contained within a confined space. This is important for ensuring a good stream of aerated water. The impacting jets break up and atomize within the space and entrain air drawn in through air inlets. Since the air cannot return to the atmosphere, but is contained with the water, it reaches a relatively stable state within the turbulent water and an aerated stream of water is produced. If jets impact in open atmosphere at an angle to produce atomization, either the atomized water droplets will merely combine to form a solid stream or an atomized mist will be produced. Each outlet opening 26 of the outlet portion 20 also has a pair of walls 30 separating it from adjacent outlet openings. Thus, an aerated stream of water produced by a pair of jets of water is generally directed out through a corresponding outlet opening 26.

Figure 8:
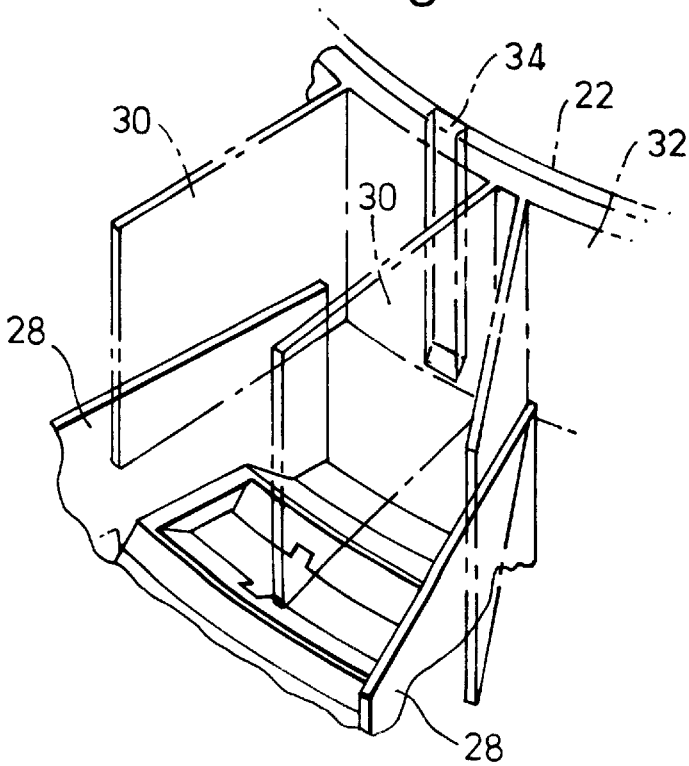
FIG. 8 illustrates how the components of FIGS. 1, 5, 6 and 7 fit together.

As best illustrated in FIG. 8, the walls 30 are provided inwardly of the walls 28. This is particularly effective in providing consistent aeration and channels the aerated water to the respective outlet openings 26.

In order to encourage good mixing of water with air, it is preferable to provide a good supply of air into the area where the jets of water impact upon one another. This may be provided by any suitable ducting, but, the present embodiment provides a particularly simple and advantageous arrangement, using the following arrangement.

As illustrated in FIG. 8, the inner wall 32 of the outlet portion 20 is of slightly larger diameter than the inner wall 22 of the base member 2. However, extensions 34 are provided between these two inner walls 22 and 32, preferably formed on the inner wall 32 of the outlet portion 20. In this way, when the outlet portion 20 is fitted into the annular space in the underside of the base member 2, although it is held firmly in place by the extensions 34, a series of gaps are left between the inner walls 32 and 22 of the outlet portion 20 and the base member 2. This allows air to be drawn by venturi action freely from outside the device into the area where the pairs of jets of water impact upon one another.

The outlet portion 20 is located with respect to the base member 2 by means of indents 36 around the inner wall 32 of the outlet portion 20 which engage with the tops of walls 28 to prevent relative rotation. Furthermore, the outer periphery of the outlet side of outlet portion 20 may be dimensioned to engage the base member 2 in a generally sealing manner.

In a modification of the embodiment described above, the base member 2 may be formed with other annular arrays of apertures radially inside and/or outside the V-shaped portion 6. These apertures may be part of one or more further annular V-shaped portions so as to produce further aerated streams of water. Alternatively, they may form part of a multi-function shower head and means may be provided selectively to direct inlet water either to the V-shape portion 6 illustrated in the figures or to one of the other arrays of apertures producing streams of water of different types.

I claim:

1. A device for producing a stream of aerated water, the device comprising:

first means for producing a first jet of water; and second means for producing a second jet of water directed so as to impact with the first jet of water; wherein the first and second means are each formed from respective pairs of co-operating surfaces, at least one co-operating surface of each pair having an extended groove which, together with the other co-operating surface of that pair, defines an elongated passage for the formation of a jet of water and wherein the first means and the second means are angled relative to one another with an angle such that water traveling along the elongated passages of the first and second jets impacts at said angle so as to form a turbulent stream of water in which air is entrained, the device further comprising: an outlet for said turbulent stream of aerated water and walls for channelling said stream to said outlet.

2. A device according to claim 1 wherein:

said respective pairs of co-operating surfaces form a plurality of first and second means.

3. A device according to claim 1 having:

a first component on which both of said at least one co-operating surfaces are formed and a second component on which both of the other co-operating surfaces are formed.

4. A device according to claim 3 wherein:

said first component includes an annular generally V-shaped recess, the sides of which form respectively both of said at least one co-operating surface and the apex of which is at least partly open; and said second component has an annular shape of cross-section corresponding to the generally V-shaped recess, the sides of which form respectively both of said other co-operating surfaces.

5. A device according to claim 4 wherein:

said first component has walls defining a series of apertures along said apex, each aperture being positioned at the ends of a pair of said grooves.

6. A device according to claim 1 wherein:

a co-operating surface of each pair of co-operating surfaces is made of a resilient material.

7. A device according to claim 1 wherein:

both said first means and said second means are fed from a common supply of water.

8. A device according to claim 1 wherein said walls define gaps allowing air to be drawn by venturi action from outside the device into the area where the first and second jets impact.

9. A shower head for producing a stream of aerated water, the shower head comprising:

first means for producing a first jet of water; and second means for producing a second jet of water directed so as to impact with the first jet of water; wherein the first and second means are each formed from respective pairs of co-operating surfaces, at least one co-operating surface of each pair having an extended groove which, together with the other co-operating surface of that pair, defines an elongated passage for the formation of a jet of water and wherein the first means and the second means are angled relative to one another with an angle such that water traveling along the elongated passages of the first and second jets impacts at said angle so as to form a turbulent stream of water in which air is entrained, the shower head further comprising:

an outlet for said turbulent stream of aerated water and walls for channelling said stream to said outlet.

10. A shower head according to claim 9 wherein:

said respective pairs of co-operating surfaces form a plurality of first and second means.

11. A shower head according to claim 10 wherein:

a co-operating surface of each pair of co-operating surfaces is made of a resilient material.

12. A shower head according to claim 9 wherein:

both said first means and said second means are fed from a common supply of water.

13. A shower head according to claim 9 wherein said walls define gaps allowing air to be drawn by venturi action from outside the device into the area where the first and second jets impact.

14. A shower head for producing an aerated shower of water, the head comprising:

first means for producing a plurality of first jets of water; and second means for producing a corresponding plurality of second jets of water directed such that each of said second jets of water impacts with a respective said first jet of water; wherein said first means and said second means are angled relative to one another with an angle such that the plurality of first and second jets impact with one another at said angle so as to form corresponding turbulent streams of water in which air is entrained, the shower head further comprising:

a surface defining a plurality of outlets corresponding to said turbulent streams of aerated water; and extending walls for channelling said turbulent streams of water such that said turbulent streams of water travels along said extending walls to said outlets.

15. A shower head according to claim 14 wherein said walls define gaps allowing air to be drawn by venturi action from outside the shower head into the areas where the first and second jets impact.

16. A method of constructing a device for producing a stream of aerated water, the device comprising a first channel for producing a first jet of water and a second channel for producing a second jet of water directed so as to impact with the first jet of water to form a turbulent stream of water in which air is entrained, the method comprising forming each channel from a respective pair of surfaces which are mounted together so as to form a substantially sealing interface, at least one of each pair of surfaces having a groove which forms the respective channel and angling the first and second channels relative to one another such that the first and second jets impact with one another at said angle so as to form a turbulent stream of water in which air is entrained;

forming an outlet for said stream of aerated water; and forming extending walls for channelling said stream such that said stream of water travels along said extending walls to said outlet.

17. A method according to claim 16 further comprising:

forming a first component having two relatively angled first surfaces;

forming a second component having two oppositely relatively angled second surfaces, each of said respective pair of surfaces having one of said first surfaces and one of said second surfaces; and mounting said first component adjacent said second component.

* * * * *

UNITED STATES PATENT AND TRADEMARK OFFICE

CERTIFICATE OF CORRECTION

PATENT NO. : 6,029,912

DATED : February 29, 2000

INVENTOR(S) : Jack Francis David Woolley

It is certified that error appears in the above-identified patent and that said Letters Patent is hereby corrected as shown below:

Column 2, line 67, "being-formed" should be --being formed--.

Column 6, line 31, Claim 11, "10" should be --9--.

Signed and Sealed this

Thirteenth Day of March, 2001

*Attest:*

Nicholas P. Godici

NICHOLAS P. GODICI

*Attesting Officer*

*Acting Director of the United States Patent and Trademark Office*